US006476559B2

(12) United States Patent
Rapp

(10) Patent No.: US 6,476,559 B2
(45) Date of Patent: Nov. 5, 2002

(54) CEREMONIAL LUMINARY AND ASSOCIATED PROCESS

(75) Inventor: Gary L. Rapp, Athens, IL (US)

(73) Assignee: Good Shepherd Lutheran Church, Sherman, IL (US)

( * ) Notice: Subject to any disclaimer, the term of this patent is extended or adjusted under 35 U.S.C. 154(b) by 0 days.

(21) Appl. No.: 09/773,240

(22) Filed: Jan. 31, 2001

(65) Prior Publication Data

US 2002/0101195 A1 Aug. 1, 2002

(51) Int. Cl.[7] ..... H05B 39/10

(52) U.S. Cl. ..... 315/88; 315/91; 315/92; 315/56; 362/13; 362/20; 362/254; 314/1

(58) Field of Search ..... 315/88, 90, 89, 315/91–93, 56, 291; 362/13, 20, 254, 362, 363; 314/1

(56) References Cited

U.S. PATENT DOCUMENTS 3,599,036 A * 8/1971 Haymaker ..... 315/93
3,659,179 A * 4/1972 Barker et al. ..... 320/2
3,809,917 A * 5/1974 Vore ..... 307/39
4,034,259 A * 7/1977 Schoch ..... 315/93
4,104,560 A * 8/1978 Kato et al. ..... 315/83
4,228,486 A 10/1980 Matsuya ..... 362/237
4,700,110 A * 10/1987 McNair et al. ..... 315/87
5,216,328 A * 6/1993 Lu ..... 318/88
5,641,226 A * 6/1997 Jautz, Jr. ..... 362/363
5,665,984 A 9/1997 Hasegawa et al. ..... 257/94
6,118,091 A 9/2000 Matsumoto et al. ..... 200/293
6,169,373 B1 * 1/2001 Riesinger ..... 315/200 A
6,177,811 B1 1/2001 Fuse et al. ..... 326/119
6,177,843 B1 1/2001 Chou et al. ..... 331/25
6,286,976 B1 * 9/2001 Chopra et al. ..... 362/183

* cited by examiner

*Primary Examiner*—Don Weng
*Assistant Examiner*—Tuyet Vo
(74) *Attorney, Agent, or Firm*—Husch & Eppenberger, LLC; Robert E. Muir; H. Frederick Rusche

(57) ABSTRACT

A ceremonial illuminary including a voltage supply mechanism, a switching mechanism that is electrically connected to the voltage supply mechanism, a first lamp electrically connected to the switching mechanism, a second lamp electrically connected to the switching mechanism wherein the switching mechanism provides voltage to the first lamp to illuminate the first lamp and then switches to provide voltage to the second lamp instead of the first lamp when the first lamp burns-out and no longer illuminates. The first lamp and the second lamp are secured with an enclosure.

15 Claims, 2 Drawing Sheets

CEREMONIAL LUMINARY AND ASSOCIATED PROCESS

FIELD OF THE INVENTION

This invention generally relates to religious devices and more particularly to a ceremonial luminary utilized in worship.

BACKGROUND OF THE INVENTION

Light has played an important role in symbolic and ceremonial proceedings for thousands of years. Illumination and light are felt to be the symbol of a deity across a wide range of religions and non-secular organizations. This illumination can also represent qualities such as love, sacrifice and communication or prayer with that deity. In Christianity, for example, both Jesus and God are symbolically represented, throughout the Bible, as light.

One aspect of all religions is the eternal, never-ending and constant presence of the respective deity. This is a crucial and vital aspect of the religion or non-secular organization. By having a luminary, in the form of a lamp, constantly shine in the place of worship, provides this symbolic presence of the deity for the worshiper and provides a constant reminder for everything that the light signifies. These illuminaries typically have the designation as eternal lights. However, a significant problem is that these illuminaries have a finite life. Even if the source of energy or fuel is constant, the portion of the illuminary that transmits light will inevitably burnout. This can be demoralizing to the group of people worshipping or attending a ceremony due to the infinite and timeless symbolic qualities brought into existence by the light. When the illuminary ceases to provide light, all of the symbolic and ceremonial aspects associated therewith will be negated by showing the transitory and finite nature of life. The uplifting and everlasting qualities provided by an illuminary, having a designation as eternal light, will then have the opposite effect and leave people with a hollow and empty feeling after the ceremony.

The present invention is directed to overcoming one or more of the problems set forth above.

SUMMARY OF THE INVENTION

In one aspect of this invention, a ceremonial illuminary is disclosed. The ceremonial illuminary includes a voltage supply mechanism, a switching mechanism that is electrically connected to the voltage supply mechanism, an enclosure, a first lamp electrically connected to the switching mechanism and secured within the enclosure, and a second lamp electrically connected to the switching mechanism and secured within the enclosure, wherein the switching mechanism provides voltage to the first lamp to illuminate the first lamp and then switches to provide voltage to the second lamp instead of the first lamp when the first lamp burns-out and no longer illuminates.

In another aspect of this invention, a process for providing illumination with ceremonial lighting for symbolic and ceremonial purposes is disclosed. The process includes providing voltage to the first lamp, that is electrically connected to a switching mechanism, wherein the switching mechanism is electrically connected to a voltage supply mechanism, to illuminate a first lamp, and switching to provide voltage to a second lamp, that is electrically connected to the switching mechanism, instead of the first lamp when the first lamp burns-out and no longer illuminates, wherein the first lamp and the second lamp are secured within an enclosure.

BRIEF DESCRIPTION OF THE DRAWINGS

Reference is now made more particularly to the drawings which illustrate the best presently known mode of carrying out the invention and wherein similar reference characters indicate the same parts throughout the views.

DETAILED DESCRIPTION

In the following detailed description numerous specific details are set forth in order to provide a thorough understanding of the invention. However, it will be understood by those skilled in the art that the present invention may be practiced without these specific details. For example, the invention is not limited in scope to the particular type of industry application depicted in the figures. In other instances, well-known methods, procedures, and components have not been described in detail so as not to obscure the present invention.

Figure 1:
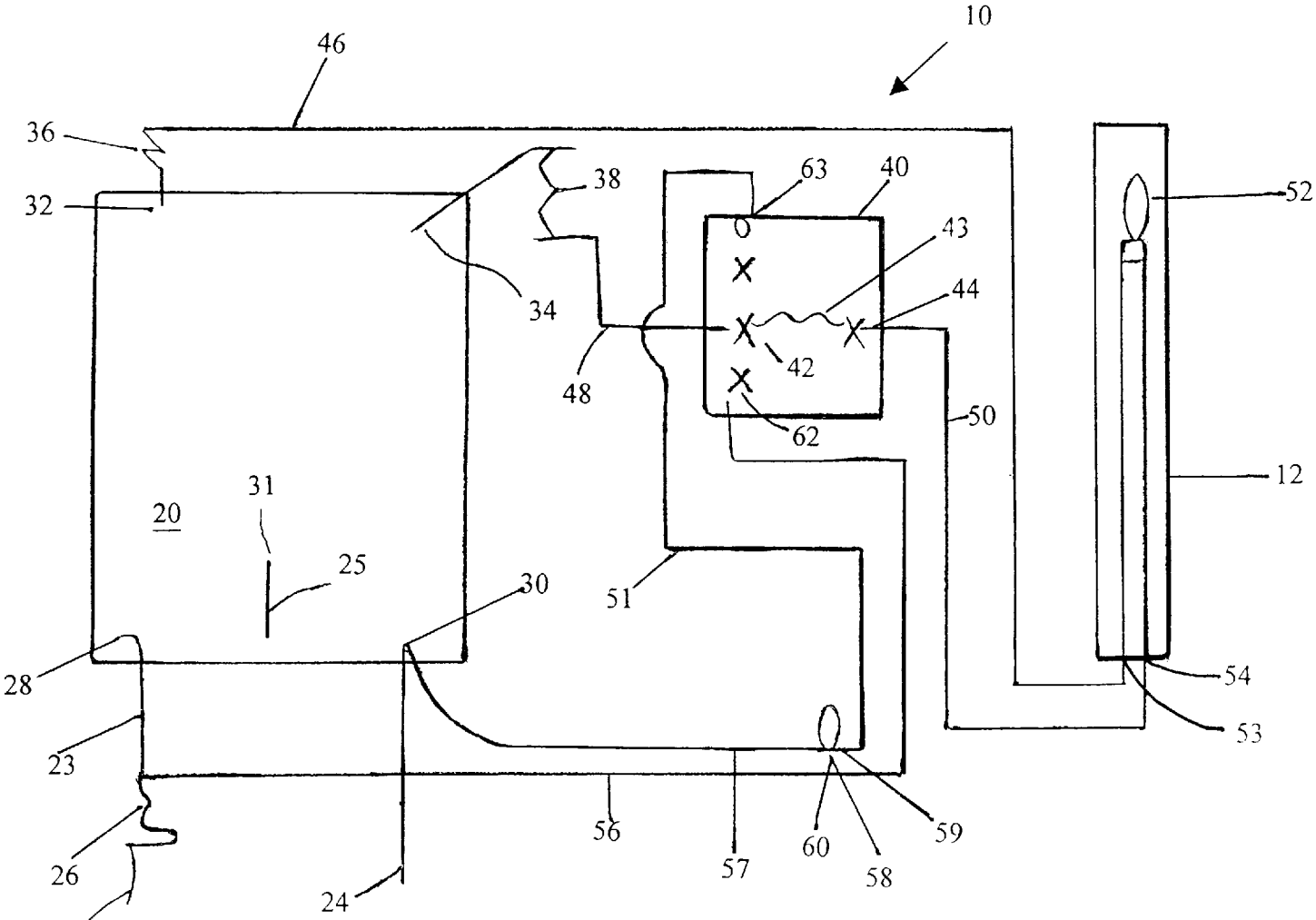
FIG. 1 is an electrical schematic of the present invention illustrating a voltage supply mechanism electrically connected to a switching mechanism that is electrically connected to both a first lamp and a second lamp.

Referring now to the drawings, and initially to FIG. 1, which illustrates an electrical schematic of the present invention illustrating a ceremonial illuminary that is denoted generally by reference numeral 10. There is a voltage supply mechanism 20 that provides electrical energy to the ceremonial illuminary. This voltage supply mechanism 20 can vary greatly depending on the light sources utilized. In the preferred embodiment shown in FIG. 1, the voltage supply mechanism 20 is a transformer that receives 120 input volts on the primary coil and then steps that up to 240 output volts off the secondary coil could be utilized.

An illustrative, but nonlimiting, example of a transformer of this type would include one that has a length of 3.38 inches (8.59 centimeters), width of 3.34 inches (8.48 centimeters) and height of 4.19 inches (10.64 centimeters). This transformer is rated at 0.075 KVA, the primary at 240/480 volts and the secondary 120 v.a.c. This illustrative transformer has a Part No. of 4R930 and is manufactured by W.W. Grainger, Inc. located at 100 Grainger Parkway, Lake Forest, Ill. 60045.

The 120 v.a.c. source (not shown) provides power to the voltage supply mechanism 20 through a first electrical conduit 22 from a 120 v.a.c. source (not shown) that is electrically connected to one side of a 1.5 Ampere fuse 26 secured within a fuse holder (not shown) with the other end of the 1.5 Ampere fuse 26 electrically connected to a first input 28 of the primary coil of the voltage supply mechanism 20, e.g., transformer by a second electrical conduit 23.

Moreover, the neutral wire from the 120 a.c. voltage source (not shown) is connected to the voltage supply mechanism 20 through a third electrical conduit 24 that is electrically connected to a second input 30 of the primary coil of the voltage supply mechanism 20, e.g., transformer and the ground wire from the 120 a.c. voltage source (not shown) is connected to the voltage supply mechanism 20 through a fourth electrical conduit 25 that is electrically connected to a third input 31 of the primary coil of the voltage supply mechanism 20, e.g., transformer.

The first output 32 of the secondary coil of the voltage supply mechanism 20, e.g., transformer, provides 240 v.a.c. and is attached, in series, to a first 0.75 Ampere fuse 36. The first 0.75 Ampere fuse 36 is connected through a fifth electrical conduit 46 to a first input 53 for a first lamp socket 74 (FIG. 2) for a first lamp 52. Fuses can be substituted for circuit breakers throughout this patent application. An example of an circuit breaker technology is U.S. Pat. No. 6,118,091, that issued Sep. 12, 2000, which is incorporated herein by reference.

The second 34 of the secondary coil of the voltage supply mechanism 20, e.g., transformer, provides 240 v.a.c. is attached, in series, to a second 0.75 Ampere fuse 38. The second 0.75 Ampere fuse 38 is connected through a sixth electrical conduit 48 to a relay coil input 42 to a relay coil 43 for a switching mechanism 40, e.g., single pole and single throw-type (SPST) relay. A single pole and single throw-type relay is all that is required, however, a double pole and double throw type relay will suffice. The relay coil output 44 is connected through a seventh electrical conduit 50 to a second input 54 attached to the fist lamp socket 74 (FIG. 2) for the first lamp 52. Therefore, through this series circuit, there is approximately 120 v.a.c drop across the first lamp 52 and a 120 v.a.c. drop across the relay coil 43. If either the filament in the first lamp breaks or the relay coil 43 opens, the circuit is broken with a loss of power to both loads. The maximum current is approximately 24 milliAmperes through the relay coil 43 and 25 milliAmperes through the first lamp 52. Therefore, the voltage mechanism 20, using these particular lamps and relay, requires a load handling capability of at least 0.049 KVA. If the source voltage would drop to 115 v.a.c., the KVA load would be 0.051, which would create problems for a standard 0.050 KVA transformer. Therefore, in this particular illustrative example only, a 0.075 KVA transformer was selected as the voltage mechanism 20 to prevent excess heating under these particular circumstances.

The relay 40 has normally closed contacts that are open with voltage present across the relay coil 43. However, when the filament in the first lamp 52 burns out, then the voltage is no longer across the relay coil 43. Then the first electrical conduit 22 through the 1.5 Ampere fuse 26 applies 120 Volts through an eighth electrical conduit 56 to the common pole or base of the relay switch 62, which now provides voltage through the relay switch to the normally closed contact 63. Voltage from the normally closed contact 63 is provided to a first input 59 of the second lamp socket 76 (FIG. 2) to the second lamp 58 through a ninth electrical conduit 51. The magnetic pull from the relay coil 43 is simply no longer present to keep the normally closed circuit through the common pole or base of the relay switch 62 open with respect to the normally closed contact 63 so that it returns to the normally closed state. The second input 60 of the second lamp socket 76 (FIG. 2) for the second lamp 38 is electrically connected to the second input 30 of the voltage mechanism 20 through a tenth electrical connector 57. As stated above, the second input 30 to the voltage mechanism 20 is connected to the second electrical conduit 24 that provides the 120 v.a.c. to the ceremonial illuminary 10.

An illustrative, but nonlimiting, example of a lamp 52 the second lamp 58 of this type would include one that is a flicker flame chandelier-type bulb that has is clear, rated at 3 watts, bulb type of CA 5<<, candelabra base, rated at 20 volts, filament is flicker type, average rated hours of 1,500, and length of 3.25 inches. This illustrative type of first lamp 52 and second lamp 58 has a Part No. of SKU #74060 03661 and is manufactured by ABCO otherwise known as Angelo Brothers Company located at 12401 McNulty Road, Philadelphia, Pa. 19154-1099. However a wide variety of substitutes are available for the first lamp 52 and second lamp 58, which include virtually any type of electrically generated light including lamps, lights, light-emitting diodes, lasers, and so forth. An example of an electric light technology is U.S. Pat. No. 4,228,486 issued Oct. 14, 1980, which is incorporated herein by reference. An example of an light-emitting diode technology is U.S. Pat. No. at issued Sep. 9, 1997, which is incorporated herein by reference.

An illustrative, but nonlimiting, example of a switching mechanism 40, e.g., relay, of this type would include one that is a single pole and single throw type of relay. This illustrative relay would have a load carrying capability of 15 Amperes, rated at 50/60 Hertz, eight (8) pins, plug-in termination and mounted with a socket. Relays of this type are manufactured by Cutler-Hammer located at 1000 Cherrington Way, Pittsburgh, Pa. 15108. However, virtually any type of electrical switching mechanisms will suffice including, but not limited to, integrated circuits, transistors, and so forth. An example of a transistor technology is U.S. Patent No. 6,177,843 issued Jan. 23, 2001, which is incorporated herein by reference. An example of an integrated circuit technology is U.S. Pat. No. 6,177,811, issued Jan. 23, 2001, which is incorporated herein by reference.

Optionally, there can be a control box, not shown, that can house the following equipment including a voltage mechanism 20, the first 0.75 Ampere fuse 36 and associated fuse holder (not shown), the second 0.75 Ampere fuse 38 and associated fuse holder (not shown), the 1.5 Ampere fuse 26 and associated fuse holder (not shown) and the associated receptacles (not shown) for the first lamp 52 and the second lamp 58 and the switching mechanism 40, e.g., relay.

Figure 2:
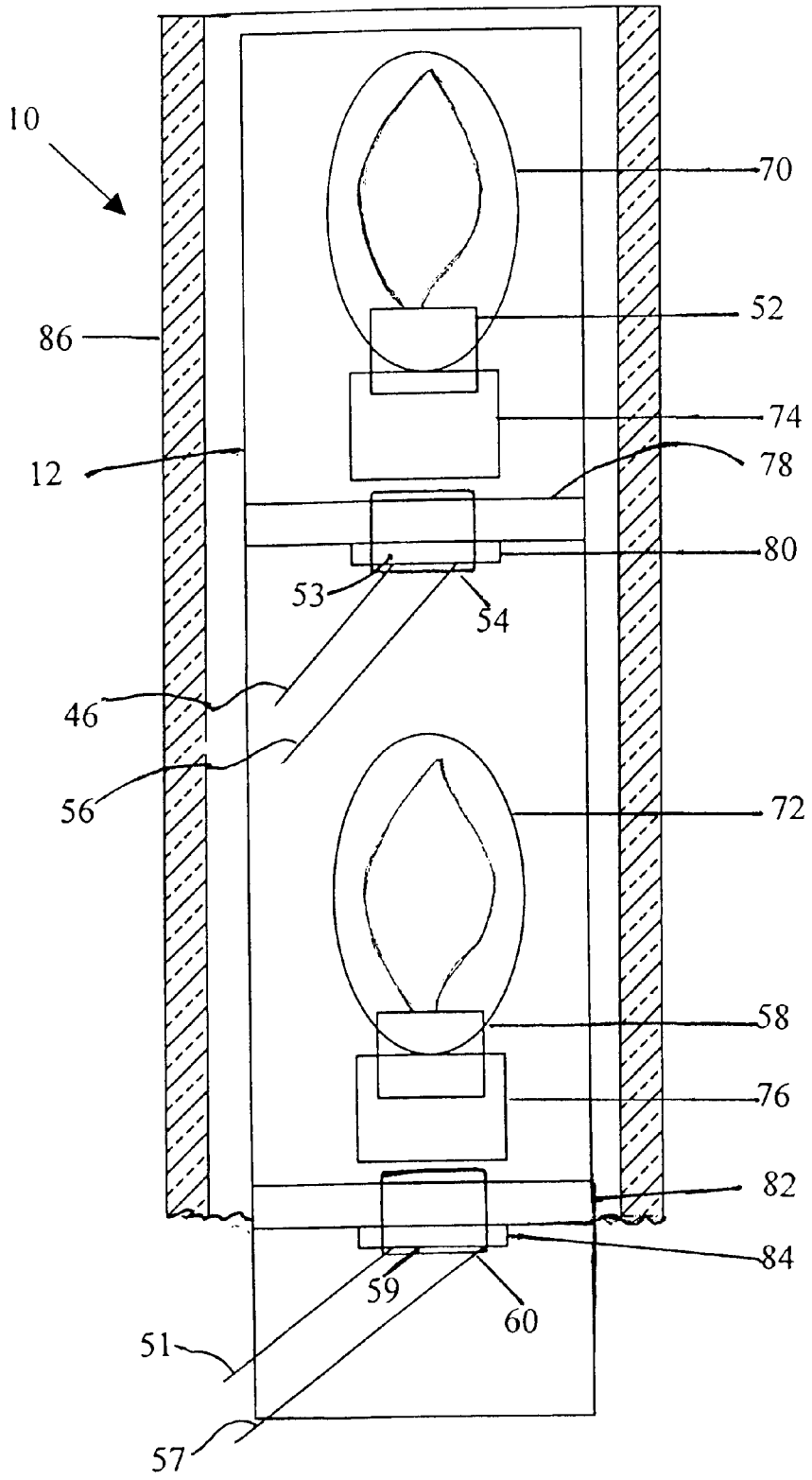
FIG. 2 is a side elevational view of the present invention with both a first lamp and a second lamp secured within an enclosure.

Referring now to FIG. 2, the ceremonial illuminary 10 includes an enclosure 12, that is preferably, but not necessarily cylindrical. In the preferred embodiment, there is a first opening 70 in the enclosure 12 to reveal the first lamp 52 and a second opening 72 in the enclosure 12 to reveal the second lamp 58. This allows the light from the first and second lamps 52 and 58 shine through the enclosure 12. The openings can be of virtually any geometric shape or size. Moreover, the enclosure 12 can be translucent or even transparent. The first lamp 52 is located within a first lamp socket 74 and the second lamp 58 is located within a second lamp socket 76. The first lamp socket 74 has a bottom portion located within an opening in a first insert ring 78. The first lamp socket 74 is secured to the first insert ring 78 by a first jam nut 80 located underneath the first insert ring 78. The first insert ring 78 is, preferably, but not necessarily, secured to the inner walls of the enclosure 12. The second socket 76 has a bottom portion located within an opening in a second insert ring 82. The second lamp socket 76 is secured to the second insert ring 82 by a second jam nut 84 located underneath the second insert ring 82. The second insert ring 82 is, preferably, but not necessarily, secured to the inner walls of the enclosure 12. Also, as shown in FIG. 2, associated with the first lamp 52 are the first input 53 and associated fifth electrical conduit 46 and the second input 54 and associated seventh electrical conduit 50 and associated with the second lamp 58 are the first input 59 and associated ninth electrical conduit 51 and the second input 60 and associated tenth electrical conduit 57.

Optionally, one way of creating the ceremonial illuminary 10 would be to mount the first lamp 52 and the second lamp 58 to the enclosure 12 that takes the form of a plastic mounting spindle. The plastic mounting spindle can be located within a hollowed, drilled out portion of a candle (not shown) and then placed within a glass candle holder 86 surrounding the candle to emit light. One illustrative embodiment for the glass candle holder 86 would be one that is red in color for religious and ceremonial significance.

INDUSTRIAL APPLICABILITY

The present invention is advantageously applicable in creating an effect of an eternal and perpetual luminary for religious and ceremonial purposes. This involves switching from a first lamp 52 to a second lamp 58 through a switching mechanism 40, e.g., relay, when the filament breaks in the first lamp. Therefore, during either a religious or non-secular ceremony, the symbolic qualities, such as love, sacrifice, communication and prayer embodied by the ceremonial luminary do not go out. This provides a steady and continuous source of hope and inspiration to all individuals attending the ceremony. It completely overcomes the transitory nature of this life by focusing on eternal and timeless qualities that are constant throughout the ages and by reflecting these qualities symbolically in the form of a ceremonial illuminary that also appears to be just as timeless and eternal.

What is claimed is:

1. A ceremonial illuminary, such as a religious eternal light having religious significance, comprising:

a voltage supply mechanism;

a switching mechanism that is electrically connected to said voltage supply mechanism, said switching mechanism including a relay;

a first lamp electrically connected to said switching mechanism;

a second lamp electrically connected to said switching, wherein said switching mechanism directs voltage to said first lamp to illuminate said first lamp and then switches to direct voltage to said second lamp instead of said first lamp when said first lamp burns-out and no longer illuminates;

means for mounting said first and second lamps adjacent one another; and a ceremonial significant enclosure surrounding said first and second lamps and means for mounting said first and second lamps.

2. The ceremonial illuminary, as set forth in claim 1, wherein said enclosure is translucent.

3. The ceremonial illuminary, as set forth in claim 1, wherein the relay is a single pole and single throw type relay.

4. The ceremonial illuminary, as set forth in claim 1, wherein said switching mechanism includes an integrated circuit.

5. The ceremonial illuminary, as set forth in claim 1, wherein said first lamp includes an electric light bulb and said second lamp includes an electric light bulb.

6. The ceremonial illuminary, as set forth in claim 1, further including at least one fuse that is electrically connected between said voltage supply mechanism and said switching mechanism.

7. The ceremonial illuminary, as set forth in claim 1, further including at least one circuit breaker that is electrically connected between said voltage supply mechanism and said switching mechanism.

8. The ceremonial illuminary, as set forth in claim 1, wherein said means for mounting positions the first and second lamps one above another.

9. The ceremonial illuminary, as set forth in claim 1, wherein the ceremonial significant enclosure is red.

10. The ceremonial illuminary, as set forth in claim 1, wherein said enclosure is cylindrical.

11. The ceremonial illuminary, as set forth in claim 10, wherein said cylindrical enclosure includes at least one elliptical opening located therein.

12. The ceremonial illuminary, as set forth in claim 1, wherein said voltage mechanism includes a transformer.

13. The ceremonial illuminary, as set forth in claim 12, wherein said transformer is a step-up transformer.

14. A method for providing illumination with ceremonial lighting for religious symbolic and ceremonial purposes comprising the steps of:

providing a first lamp;

electrically connecting said first lamp to a voltage supply mechanism through a switching mechanism to illuminate the first lamp;

providing a second lamp adjacent the first lamp;

electrically connecting the second lamp to the switching mechanism;

locating the first and second lamps within a ceremonial significant enclosure; and switching to provide voltage to the second lamp instead of said first lamp when said first lamp burns-out and no longer illuminates.

15. The method for providing illumination with ceremonial lighting, as set forth in claim 14, wherein said switching to provide voltage to a second lamp includes utilizing a relay.

* * * * *